US005966884A

United States Patent [19]

Uglow

[11] Patent Number: 5,966,884

[45] Date of Patent: Oct. 19, 1999

[54] VENTED ROOF DRAIN INSERT

[75] Inventor: Philip Uglow, Toronto, Canada

[73] Assignee: Olympic Manufacturing Group, Inc., Agewan, Mass.

[21] Appl. No.: 09/005,223

[22] Filed: Jan. 9, 1998

[51] Int. Cl.[6] ..... F04D 13/04

[52] U.S. Cl. ..... 52/302.1; 285/42; 52/198

[58] Field of Search ..... 52/302.1, 198; 285/42

[56] References Cited

U.S. PATENT DOCUMENTS

| | | |
|---|---|---|
| 118,337 | 8/1871 | Buck . |
| 696,009 | 3/1902 | Cregar . |
| 1,085,626 | 2/1914 | Mueller . |
| 2,121,613 | 6/1938 | Schultz . |
| 2,283,365 | 5/1942 | Heinkel . |
| 2,427,258 | 9/1947 | Cavalieri . |
| 4,107,929 | 8/1978 | Ebeling et al. . |
| 4,112,691 | 9/1978 | Ebeling et al. . |
| 4,492,491 | 1/1985 | Lunden et al. . |
| 4,505,499 | 3/1985 | Uglow et al. . |
| 4,799,713 | 1/1989 | Uglow . |
| 5,297,817 | 3/1994 | Hodges . |
| 5,526,613 | 6/1996 | Simeone, Jr. . |

*Primary Examiner*—Christopher T. Kent
*Attorney, Agent, or Firm*—Finnegan, Henderson, Farabow, Garrett & Dunner

[57] ABSTRACT

An improved vented drain insert for insertion into a larger diameter drain pipe, preferably, a roof drain pipe. The insert has a tubular portion which extends into the drain pipe forming an annular restriction in the primary passageway through the drain pipe. A vent tube is provided to provide a secondary passageway from above the inlet to the drain past the annular restriction to the drain pipe below the drain insert. The vent tube is believed to be advantageously vent air and/or equalize pressures below the drain insert under flow conditions in the drain pipe in which air is present in the drain pipe.

17 Claims, 5 Drawing Sheets

VENTED ROOF DRAIN INSERT

SCOPE OF THE INVENTION

This invention relates to roof drains and, more particularly, to vented roof drain inserts and to an improved configuration of a roof drain which provides for improved water flow.

BACKGROUND OF THE INVENTION

Roof drain inserts are known such as those taught by U.S. Pat. No. 4,505,499 to Uglow et al, issued Mar. 19, 1985 and U.S. Pat. No. 4,799,713 to Uglow, issued Jan. 24, 1989. Such roof drain inserts are particularly useful in situations where a roof is being resurfaced and a new roof drain is desired to be installed at a height above the existing roof drain. The roof drain inserts have an upper flange for securing to the new roof surface and a tubular member which extends coaxially down inside the existing drain pipe. Since the roof drain insert is received within the drain pipe the horizontal cross-sectional area through which water can flow is reduced in the insert as contrasted with that in the drain pipe.

SUMMARY OF THE INVENTION

The present inventor has appreciated that the restricted area for water flow through a roof drain insert can reduce the flow rate at which water can pass through the roof drain. Further, the inventor has appreciated the fact that the drain insert provides a flow path with a restricted area of flow through the insert which then opens into the full cross-sectional area of the drain pipe, can under some flow conditions, and particularly where air is present in the drain pipe or entrained in the water flow, result in reduced water flow due to the interaction of water and air.

Accordingly, to at least partially overcome these disadvantages, the present invention provides a drain with a vent tube which provides a secondary pathway for communication from above a drain inlet to below a segment of the pipe of restricted cross-sectional area.

An object of the present invention is to provide a novel vent tube for use in roof drains, an improved roof drain insert with a secondary vent passageway and a roof drain assembly incorporating a secondary vent passageway.

Another object is to provide, in a roof drain assembly with an annular restriction to flow therethrough, a secondary vent passageway providing communication from above the drain inlet to below the annular restriction.

Accordingly, in one aspect, the present invention provides in a drain assembly having a primary passageway for flow with an upper segment of reduced cross-sectional area opening into a lower segment of a greater cross-sectional area, a secondary passageway for flow extending from above an inlet to the primary passageway into the lower segment. The invention is particularly useful to assist fluid flow in the context of drains which are roof drains, however, can be advantageous in other drain environments where water may, under varying conditions, back up about a drain inlet and then flow downwardly through an area of restricted cross-sectional area before flowing into an area of increased cross-sectional area.

In another aspect, the present invention provides a roof drain insert having a tubular portion with a lower outlet end adapted for securing within a large diameter cylindrical drain pipe, said tubular portion having an upper inlet end, an upper roof engaging sealing flange extending radially outwardly from about the upper inlet end of the tubular portion to prevent flow of water therethrough other than via the upper inlet end, an annular sealing ring disposed about the tubular portion proximate the lower outlet end to form a seal between the tubular portion and the drain pipe, an air vent tube secured to the insert extending coaxially within the insert from a tube inlet end upwardly above the upper inlet end of the tubular portion to a tube outlet end below the lower outlet end of the tubular portion.

In a further aspect, a drain comprising a vertically extending primary drain passageway for flow of water vertically downwardly therethrough, an uppermost drain entrance opening opening into the primary passageway for igress of roof water therein, an annular restriction member disposed within the primary passageway blocking flow of water therethrough other than through a central vertical restriction segment of the primary passageway defined centrally within the annular restriction member, the primary passageway having a vertical exit segment immediately below the annular restriction member with the exit segment having an horizontal cross-sectional area greater than a horizontal cross-sectional area of the restriction segment and with the restriction segment opening directly into the exit segment at a juncture therebetween, a secondary passageway providing communication between an upper opening disposed at a height vertically above the drain entrance opening and a lower opening disposed within the primary passageway in the exit segment proximate the juncture between the restriction segment and the exit segment, the secondary passageway having a horizontal cross-sectional area for flow therethrough smaller than the cross-sectional area of the exit segment.

The present invention provides an improved vented drain insert for insertion into a larger diameter drain pipe, preferably, a roof drain pipe. The insert has a tubular portion which extends into the drain pipe forming an annular restriction in the primary passageway through the drain pipe. A vent tube is provided to provide a secondary passageway from above the inlet to the drain past the annular restriction to the drain pipe below the drain insert. The vent tube is believed to be advantageously vent air and/or equalize pressures below the drain insert under flow conditions in the drain pipe in which air is present in the drain pipe.

BRIEF DESCRIPTION OF THE DRAWINGS

Additional advantages and features of the present invention will appear from the following description taken together with the accompanying drawings in which.

DETAILED DESCRIPTION OF THE DRAWINGS

Figure 1:
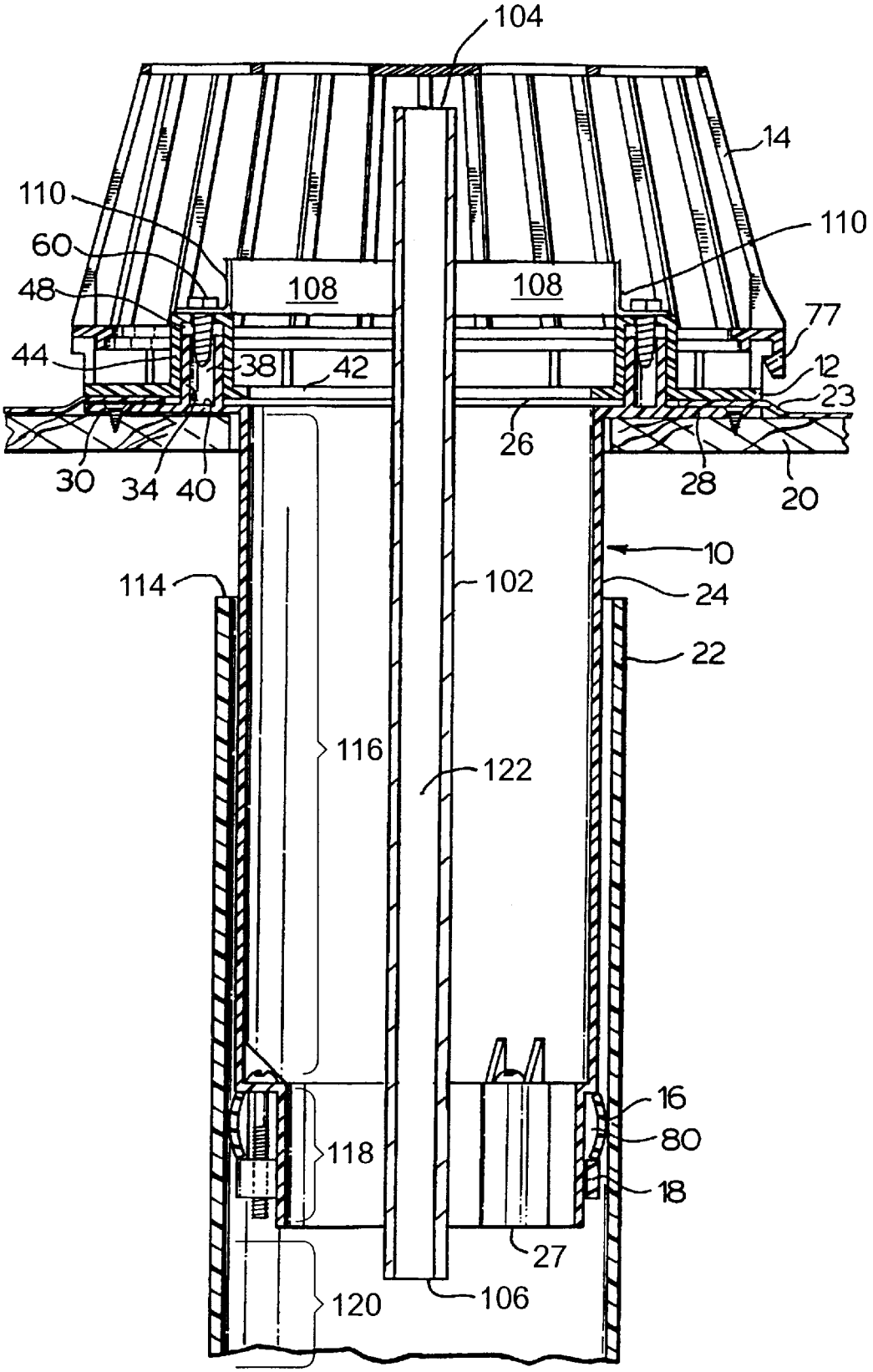
FIG. 1 is a schematic, cross-sectional side view of a roof drain assembly in accordance with the present invention.
Figure 2:
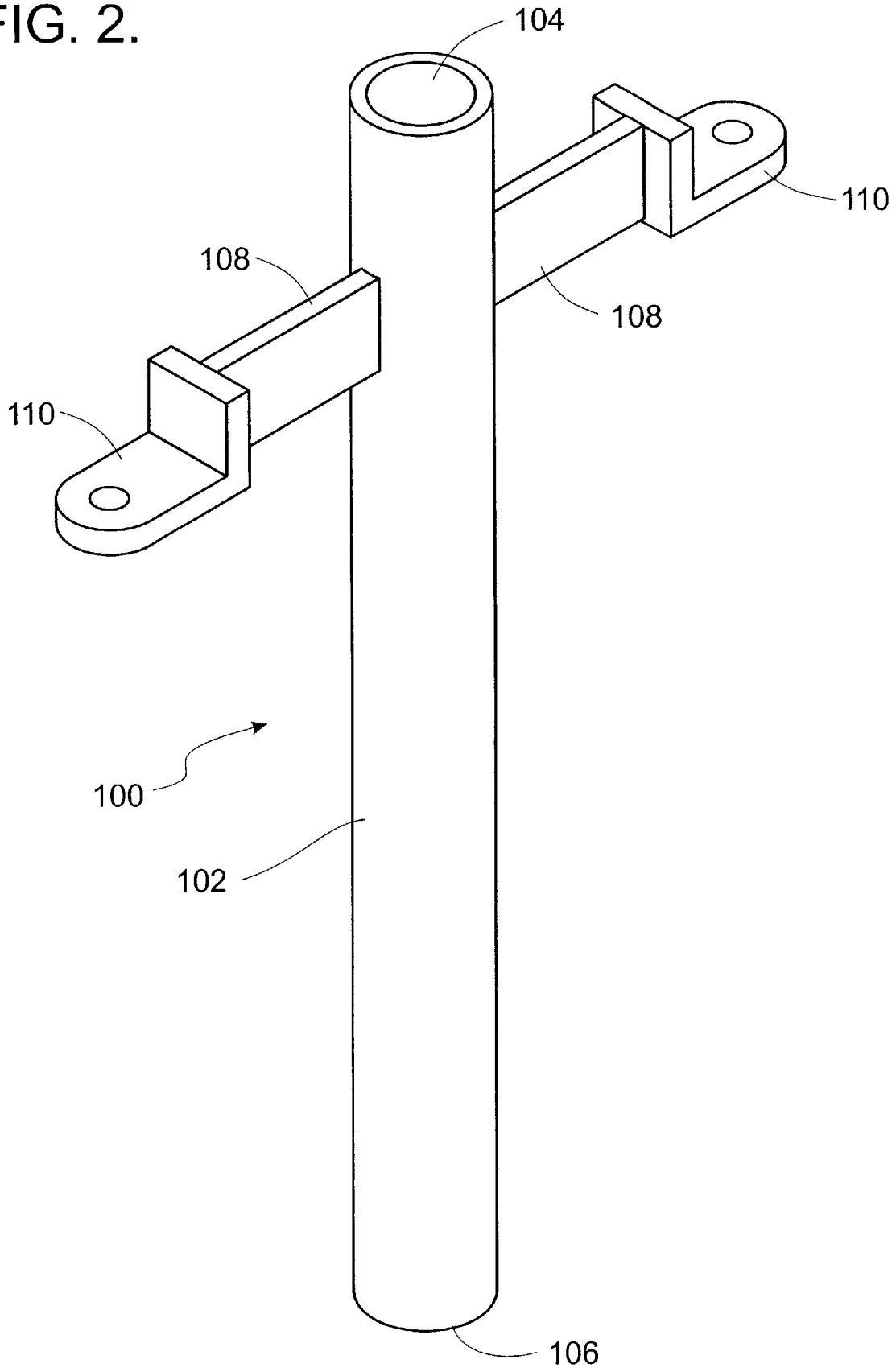
FIG. 2 is a pictorial view of a vent tube comprising part of the assembly shown in FIG. 1.
Figure 3:
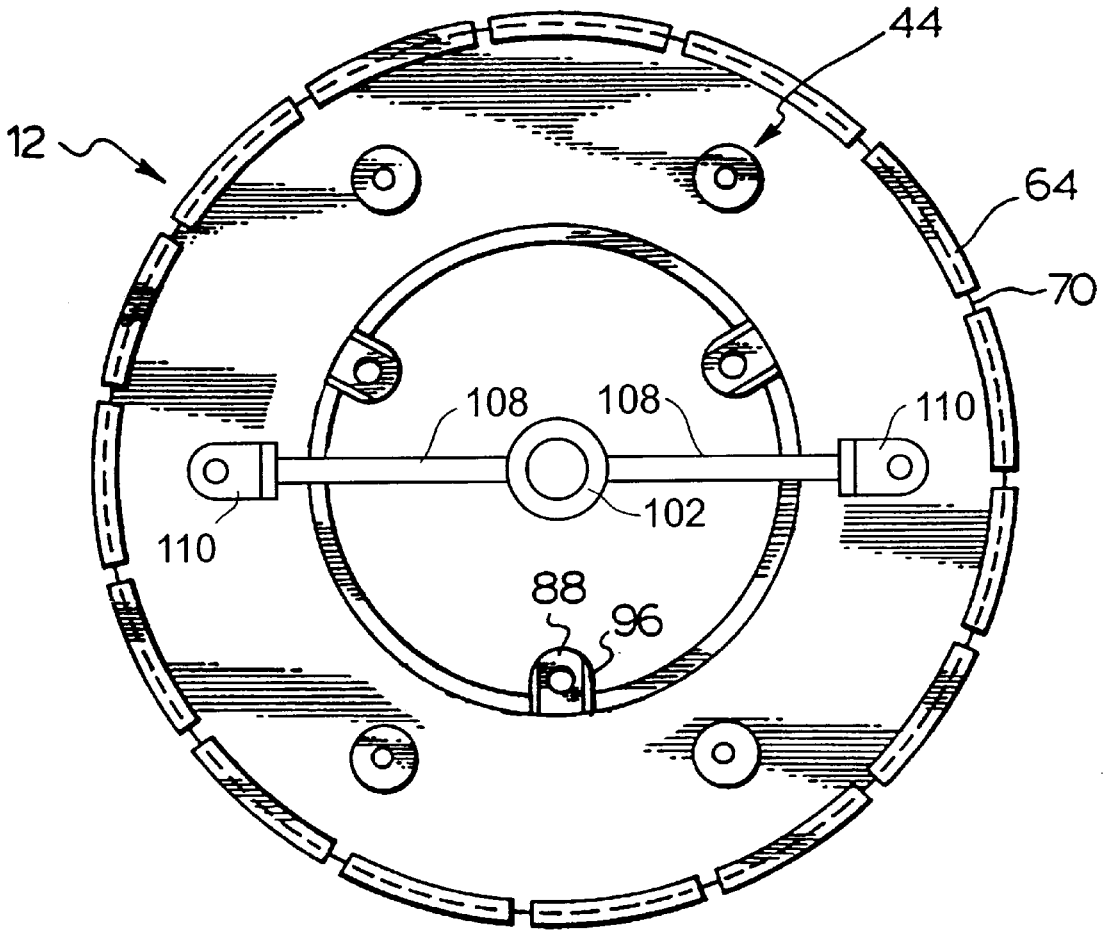
FIG. 3 is a top, elevation view of the roof drain assembly shown in FIG. 1 with the straining basket removed.

Reference is made first to FIG. 2 which shows a vent tube member 100 in accordance with the present invention which vent tube member 100 is illustrated as used in FIGS. 1 and 3 in the context of providing an improved roof drain insert and an improved roof drain assembly in accordance with the present invention. The roof drain assembly illustrated in FIGS. 1 and 3 to 9, otherwise than in respect of the vent tube member 100, is identical to that disclosed in U.S. Pat. No. 4,799,713 to Uglow, issued Jan. 24, 1989 and, therefor, FIGS. 4 to 9 which do not show the vent tube member 100 are prior art.

FIG. 1 which shows a roof drain assembly in accordance with the present invention comprising roof drain insert member 10 including vent tube member 100, clamp ring member 12, straining basket 14, seal ring 16 and washer 18.

The assembly is shown in FIG. 1 in the context of a roof generally indicated 20 supported by means not shown and below which a drain pipe 22 is located also supported by means not shown. A thin water impermeable sheeting 23 covers roof 20. The roof drain insert member 10 is sealed to both sheeting 23 and drain pipe 22 and serves to transfer water collected on the roof to the drain pipe 22.

Drain insert member 10 has a cylindrical tube portion generally indicated 24 with an upper opening 26 at its upper end and a lower opening 27 at its lower end. Member 10 also has a thin, planar flange 28 extending radially outwardly about upper opening 26.

The flange 28 is secured to the roof 20 by screws 30. Clamp ring member 12 overlies flange 28 and is secured to flange 28 clamping sheeting therebetween by screw members 60 extending through socket forming members 44 of the clamp ring member 12 to engage the post members 34 of the flange 28. The straining basket 14 is removably secured in a snap fit on a rim 64 of the clamp ring member 12.

The cylindrical tube portion 24 of the drain insert member 10 extends downwardly through the upper open end 114 of the drain pipe 22 coaxially into the drain pipe 22.

The lower end of tube portion 24 is sealed to drain pipe 22. While this may be accomplished in a number of ways, a preferred construction is shown in FIGS. 1 and 5 to 7 in accordance with the teaching of U.S. Pat. No. 4,505,499 to Uglow et al, issued Mar. 19, 1985.

Tube portion 24 is recessed inwardly about lower opening 27 so as to provide outwardly thereof an annular space 80 to receive about tube portion 24 annular seal ring 16 and washer 18 in axially sliding relation. Washer 18 has three enlarged radially inwardly extending lugs 82 each carrying metal nuts 84 secured therein. Three screws 86 extend from radial lugs 88 of tube portion 24 downward to engage nuts 84 and draw washer 18 upwardly so as to compress seal ring 16 preferably of compressible, elastomeric (rubber) material. Ring 16 on being compressed is urged outwardly into sealing engagement with the inside wall 90 of drain pipe 22 as well as axially into the recessed, radially inwardly extending annular shoulder 92 of tube portion 24. As shown, annular space 80 is only of a radial inward extent equal to the thickness of ring 16 except at three places where it is enlarged under lugs 88 as at 94 to accommodate lugs 82 of washer 18. Lugs 88 present an upper flat surface which the head of screw 86 may engage between reinforcing flanges 96. Screws 86 are accessible through upper opening 26.

The vent tube member 100 comprises a hollow cylindrical tube 102 with an open upper end 104 and an open lower end 106.

The vent tube member 100 has two support arms 108 secured thereto carrying L-shaped washer-like members 110. As best seen in FIG. 1, the vent tube member 100 is secured to the roof drain insert member by the support arms 108 spanning the opening 26 and having its members 110 secured by screw members 60 in opposing socket forming members 44 and post members 34. As seen, the tube 102 is located coaxially within both the drain pipe 22 and the tube portion 24 of the drain insert member 10. The upper end 104 of tube 102 is located at a height above the opening 26 in the drain insert member 10. The lower end 106 of tube 102 is located below the lower end 27 of the tube portion 24.

The assembly as shown in FIG. 1 provides, in effect, a primary flow passageway which extends from the opening 26 of the insert member 10 through the tube portion 24 and out of the tube portion into the drain pipe 22. In this regard, the primary passageway may be seen to have segments of different horizontal cross-sectional area, namely, an entrance segment indicated as 116, a restriction segment indicated as 118 and an exit segment indicated as 120.

The tubular portion 24, in effect, provides an annular restriction within the drain pipe 22 such that the horizontal cross-sectional area of the tubular portion, especially in the restriction segment 118, is less than the horizontal cross-sectional area of the drain pipe 22.

The cross-sectional area of the primary passageway abruptly increases on moving downwardly from the restriction segment 118 into the exit segment 120 as in the manner of a step increase at their juncture.

The enlarged cross-sectional area in the exit segment 120 immediately below the annular restriction formed by the insert member 10 provides a location where under certain flow conditions, air may become entrapped in the primary passageway by water flowing down the drain. The tube 102 provides a secondary passageway 122 providing communication through the tube 102 between the upper end 104 and lower end 106. The upper end 104 is disposed above the upper opening 26 to the primary passageway, such that under conditions of relatively high water flow, the upper end 104 is above the height of water which may back up on the roof. The lower end 106 is disposed below the restriction segment 118 in the exit segment 120 but, preferably, proximate the juncture between the restriction segment 118 and exit segment 120 to assist in providing communication to the exit segment 120 proximate where the primary passageway widens into the exit segment 120.

Operation of the drain assembly with the vent tube member 100 is not fully understood. At low water flow rates, the vent tube member 106 is not believed to have any substantial effect on water flow as compared to an assembly without the vent tube member. As the water flow rate increases, conditions will be reached where air becomes entrapped in the exit segment 120 and/or the entry segment 116 as by being within the drain pipe 22 below the insert member 10 when the higher water flow commenced or by reason of being entrapped in downward flowing water and released into the exit segment 120. In a drain assembly without the vent tube member, the entrapped air can cause increased resistance to water flow through the drain pipe. However, in a drain assembly with the vent tube member, the vent tube provides the second passageway to equalize and/or relieve pressure differentials between the ends of the tube 100 as, for example, to vent air upwardly from the exit segment 120 immediately below the insert member 10 or to permit air to be drawn downwardly through the vent tube. As rain on the roof may accumulate in a heavy rain and the water level on the roof may rise with increased backlog, the vent tube can readily assist in equalizing pressures as by venting air while the upper end 104 is above the water level. By the time the water level may rise above the upper end 104 of the tube 102, the air venting is likely substantially complete so that with the water level above the upper end 104, most of the air may be removed from the system and water may fill and flow down both the primary passageway and the secondary passageway.

The preferred embodiment illustrated in FIG. 1 roughly approximates an assembly with a drain pipe 22 of an inside diameter of 3 inches for a cross-sectional area of about 7.1 sq. in.; an insert member 10 with a restriction segment 118 of a diameter of about 2.5 inches for an area of about 4.9 sq. in.; an entrance segment diameter of about 2.75 inches for an area of about 5.9 sq. in.; and a tube 100 of an external diameter of about ½ inches and an internal diameter of about ⅜ inches for an internal cross-sectional area of about 0.11 sq. in. Preferably, the area of the secondary passageway is substantially smaller than that of the primary passageway. Preferably, the cross-sectional area of the secondary passageway is less than 10%, preferably, less than 5% of the cross-sectional area of the drain pipe 22.

Conventional roof drain pipes such as 22 most typically have an interior diameter in the range of about 3 to 6 inches. Typical roof drain inserts having annular sealing rings such as 10 may be expected to have diameters in their restriction segment of at least about one half inch less than the diameter of the drain pipe. For a 6 inch drain pipe, this represents about 23% less cross-sectional area in the restriction segment than in the exit segment and, for a three inch drain pipe, this represents about 30% less cross-sectional area in the restriction segment than in the exit segment. The present invention is, therefore, preferable for use in drain assemblies in which the annular restriction represents at least about a 15% reduction in the cross-sectional area of the drain pipe 22, more preferably, at least about a 23% reduction.

In conventional drain pipes of about 6 inch to 3 inch diameters, vent tubes having various cross-sectional sizes can be used. Preferred vent tubes have an internal diameter in the range of 0.25 inches to 1 inch, more preferably, about ⅜" to ⅝". The cross-sectional area of the drain pipe 22 is preferably about 30 to 100 times the internal cross-sectional area of the vent tube.

FIGS. 1 to 3 show the vent tube 102 located coaxially centered within the drain insert member 10. This is not necessary. The vent tube 102 could be provided at other locations as, for example, adjacent one side wall of the drain insert member 10, possibly secured by but one screw 60 at its top. The secondary passageway could be provided integrally in the side wall of the drain insert member and could be provided inside and outside or in part inside and in part outside of the side wall of the drain insert member.

The upper end 104 of the vent tube 100 in the preferred embodiment shown is located above the opening 26 by approximately between 20% to 100% of a diameter of the drain pipe 22 yet below the top of the straining basket 24.

The lower end 106 of the vent tube 100 is preferably located a distance below the end of the restriction segment 118 between about 20% to 100% of the diameter of the drain tube 22.

The preferred vent tube 100 is shown secured in place, namely, by support arms 108. Additional support and/or locating devices could be provided as near the lower end 106 to keep the vent tube 100 in a desired location. It is preferred, however, that any support devices be minimized to not restrict water flow or flow of debris through the drain.

Figure 4:
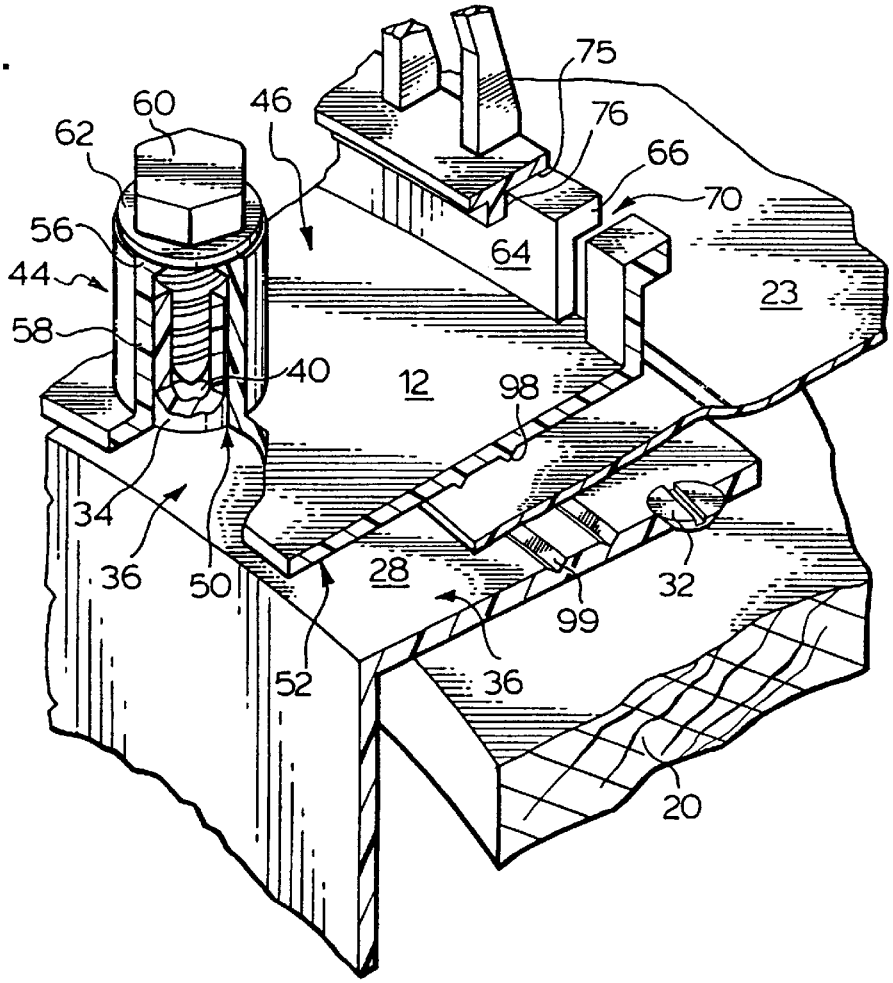
FIG. 4 is a partially cut away pictorial view showing a segment of the roof drain assembly of FIG. 1.
Figure 5:
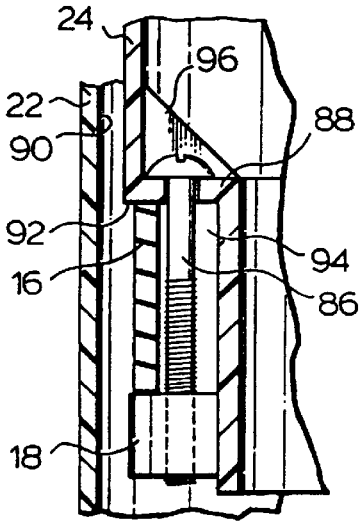
FIG. 5 shows an enlarged cross-sectional side view of the lower end of the assembly of FIG. 1 in an unsealed configuration.
Figure 6:
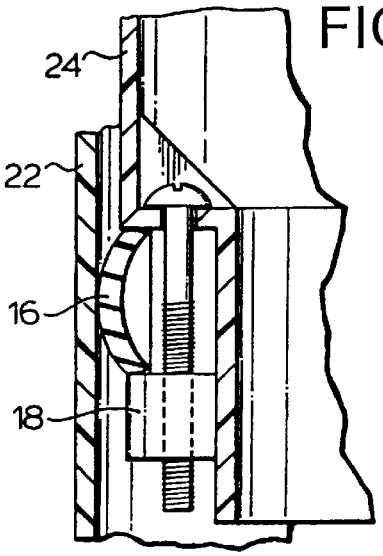
FIG. 6 is a view similar to FIG. 5 but showing a sealed configuration.
Figure 7:
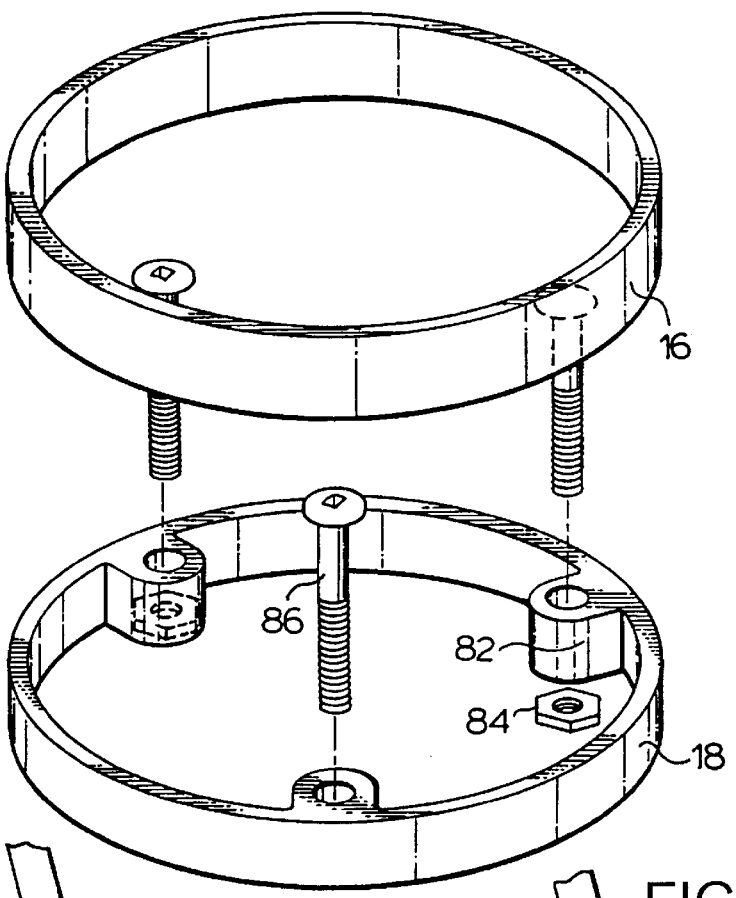
FIG. 7 shows in an exploded, schematic view, screws, a seal ring and a washer comprising portions of the assembly shown in FIG. 1.

Other features of the roof drain insert shown in FIGS. 4 to 9 are now discussed in more detail. Referring to FIG. 4, flange 28 has circumferentially spaced, counter-sunk holes 30 therein, through which recessed head screws 32 extend to secure flange 28 to roof 20 with a lower surface of flange 28 in locating abutment with an upper surface of roof 20.

Flange 28 carries six post members 34 which extend upwardly beyond upper surface 36 of flange 28. Each post member 34 is shown to be substantially cylindrical and to have a central aperture 38 which extends downwardly into post member 34. Central aperture 38 does not extend entirely through flange 28 but rather terminates as a blind end 40.

Clamp ring member 12 overlies flange 28 such that a central opening 42 through ring member 12 provides access to tubular portion 24 via upper opening 26. Substantial portions of ring member 12 are relatively thin and planar.

Six socket forming members 44 are provided on ring member 12 each rising above the upper surface 46 of ring member 12. Socket forming members 44 each define a socket recess 48 therein. Recess 48 has a lower opening 50 in lower surface 52 of ring member 12. Socket forming members 44 constitute a generally cylindrical upstanding wall 58 which at its upper end preferably extends radially inwardly to provide an inwardly extending flange 56 at the top of member 44. An entrance aperture extends downwardly through the top of each member 44 into socket recess 48.

Socket forming members 44 are complementarily located having regard to the location of post members 34 so that each socket recess 48 may receive a post member 34 therein.

Screw member 60 extends downwardly through the top of socket forming member 44 via the entrance aperture and into central aperture 38 of a post member 34 received inside socket recess 48. Screw member 60 engages post member 34 to urge ring member 12 onto flange 28. Preferably, screw member 60 carries a washer 62 to distribute loads onto socket forming member 44.

With sheeting 23 located between flange 28 and ring member 12 circumferentially about flange 38, sheeting 23 can be clamped between ring member 12 and flange 28 to form a seal entirely about the periphery of the drain assembly.

Although not necessary, screws 32 fastening flange 28 to roof 20 may be located under sheeting 23 and flush with the upper surface of flange 28.

Ring member 12 preferably is provided at its outer edge with a segmented rim 64 which extends vertically upwardly (axially) above upper surface 46 of ring member 12 to where rim 64 has an enlarged radially outwardly extending flange-like lip 66. Rim 64 is shown as a plurality of circumferentially spaced segments, each designated 64 separated by vertical spaces or cut-out portions 70 extending downwardly to the height of upper surface 46 of ring member 12 as best seen in FIG. 4. When used in securing roof sheeting 23, spaces 70 permit water to pass through rim 64 when the water rises merely to the height of upper surface 46 of the ring member.

Figure 8:
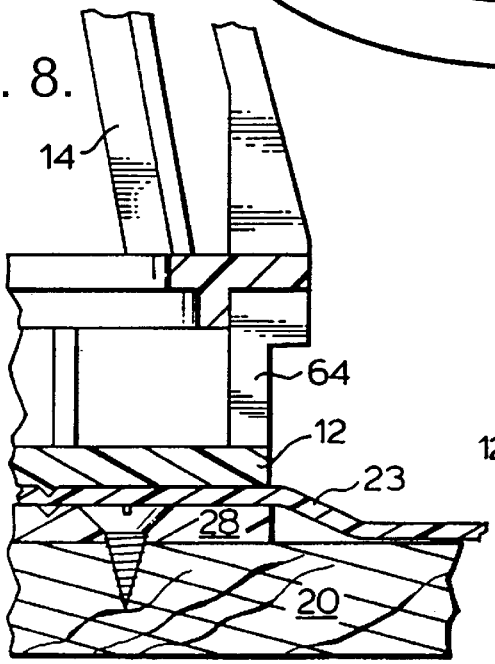
FIG. 8 shows an enlarged cross-sectional view of portions of the assembly in FIG. 1 clamping a roof sheeting.
Figure 9:
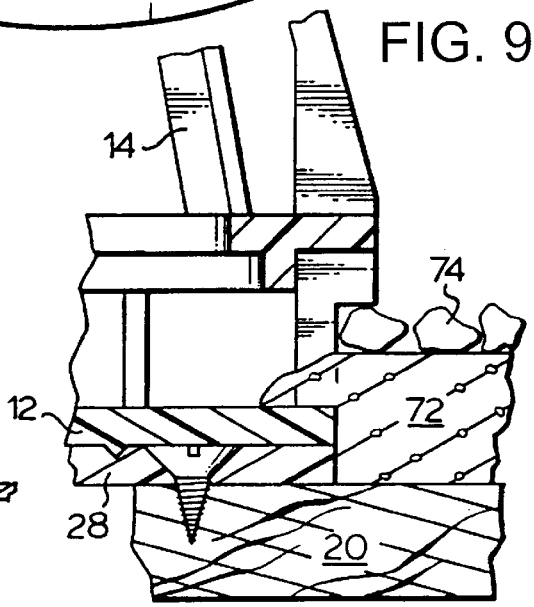
FIG. 9 shows a view similar to FIG. 8 but with a layer of asphalt and gravel substituted for the roof sheeting.

While FIGS. 1, 4 and 8 show use of a drain assembly in its preferred use with roof sheeting 23, the drain assembly can also be used with an asphalt type roof sealing system as shown in FIG. 9 in which a layer 72 of tar, asphalt or other sealant, preferably covered by gravel 74, may be poured directly over roof 20. In this case, ring member 12 is urged directly onto flange 28. Segmented rim 64 serves to help the asphalt or tar 72 and gravel 74 from entering the drain.

In order to securely grip sheeting 23, as seen in FIG. 4, the lower surface 52 of ring member 12 may have one or more downwardly extending angular ridges 98. Preferably, complementary located and sized grooves 99 may be provided in the upper surface 36 of flange 28, to assist in gripping sheet 23 and also, as shown in FIG. 9 when no sheet is between the ring member 12 and flange 28, to accommodate ridges 98.

The drain assembly preferably has a straining basket 14 which prevents leaves, twigs, paper and the like from entering and clogging the drain. Basket 14 is shown to have a lower peripheral edge 75 with a downwardly extending inner projection 76 to closely contact the radially inside surface of rim 64. Preferably, three catch members 77 are provided on basket 14 as seen in FIG. 1. Catch members 77 engage under lip 66 to securely retain basket 14 onto ring member 12. With basket 14 having some resiliency, basket 14 may be snapped on and off of lip 66.

Preferably, each of drain insert member 10, ring clamp member 12, straining basket 14 and washer 18 may be moulded from plastic as by injection moulding. The particular configuration of the post members permits moulding of the drain insert member with a two piece mould with the tube portion tapering a minor, insignificant amount downwardly. One piece of the mould may provide the upper and inside surfaces while the other peice of the mould may provide the lower and outer surfces of the tube portion 24.

Providing the post members and socket forming members to be upstanding about the upper surfaces of the flange and the clamp ring member is advantageous where asphalt, tar or other sealing materials are to be applied and frequently are to be slopped onto a drain, making location of screw holes difficult.

With the post members having a blind end and effectively sealing the thread portion of screw member 60 therein, corrosion of the screw member can more easily be withdrawn after the passing of time, if necessary.

In the preferred embodiment shown, the post members and socket forming members have been shown to be cylindrical. It is to be appreciated that many other complementary shapes could also be used.

While the invention has been described with reference to preferred embodiments, the invention is not so limited. Many variations and modifications will now occur to those skilled in the art. For a definition of the invention, reference is made to the appended claims.

I claim:

1. A roof drain insert having a tubular portion with a lower outlet end adapted for securing within a large diameter cylindrical drain pipe, said tubular portion having an upper inlet end, an upper roof engaging sealing flange extending radially outwardly from about the upper inlet end of the tubular portion to prevent flow of water therethrough other than via the upper inlet end, an annular sealing ring disposed about the tubular portion proximate the lower outlet end to form a seal between the tubular portion and the drain pipe, an air vent tube secured to the insert extending coaxially within the insert from an upper tube end upwardly above the upper inlet end of the tubular portion to a lower tube end below the lower outlet end of the tubular portion.

2. A roof drain insert as claimed in claim 1 wherein said sealing ring comprises a compressible ring member, the insert including a mechanism to apply compressible forces to said ring member annularly thereabout, said ring member on compression by compressive forces applied by said mechanism engaging said tubular portion to form a seal therewith and expanding radially outwardly to sealably engage the drain pipe.

3. A roof drain insert as claimed in claim 2 including activating means to activate said means to apply compressive forces, said activating means accessible for actuation through said upper inlet end of the tubular portion.

4. A roof drain insert as claimed in claim 3 wherein said sealing ring comprises compressible, elastomeric material.

5. A roof drain insert as claimed in claim 3 wherein a radially inwardly directed flange is provided on said tubular portion proximate said lower outlet end, said sealing ring having a portion on an axial end thereof to engage said inwardly directed flange and on compression by said mechanism to form a seal therewith.

6. A roof drain insert as claimed in claim 5 including a washer member wherein said ring member is located axially between said inwardly directed flange and said washer member so as to be sandwiched therebetween, said mechanism comprising axially extending force transmitting means coupling the washer member to the inwardly directed flange for activation by the activation means to apply axially directed compressive forces to said ring.

7. A drain comprising a vertically extending primary drain passageway for flow of water vertically downwardly therethrough, an uppermost drain entrance opening, opening into the primary passageway for igress of roof water therein, an annular restriction member disposed within the primary passageway blocking flow of water therethrough other than through a central vertical restriction segment of the primary passageway defined centrally within the annular restriction member, the primary passageway having a vertical exit segment immediately below the annular restriction member with the exit segment having a horizontal cross-sectional area greater than a horizontal cross-sectional area of the restriction segment and with the restriction segment opening directly into the exit segment at a juncture therebetween, a secondary passageway providing communication between an upper opening disposed at a height vertically above the drain entrance opening and a lower opening disposed within the primary passageway in the exit segment proximate the juncture between the restriction segment and the exit segment, the secondary passageway having a horizontal cross-sectional area for flow therethrough smaller than the cross-sectional area of the exit segment.

8. A drain as claimed in claim 7 including a hollow tube member coupled to the drain extending vertically within the primary passageway from an upper end above the drain entrance opening down through the restriction section to a lower end located within the outlet section, the secondary passageway provided within the tube member and with the upper end of the tube member comprising the upper opening to the secondary passageway and the lower end of the tube member comprising the lower opening to the secondary passageway.

9. A drain as claimed in claim 8 wherein the primary passageway having a vertical entrance segment immediately above the annular restriction member, the vertical entrance segment having a horizontal cross-sectional area greater than a horizontal cross-sectional area of the restriction segment.

10. A drain as claimed in claim 9 wherein the entrance segment extends from the drain entrance opening to the restriction segment.

11. A drain as claimed in claim 7 including a vertical cylindrical drain pipe with an open upper end, a drain insert comprising a tubular portion with upper and lower open ends and an upper flange extending radially outwardly from about the upper end of the tubular portion, the drain insert secured in the drain pipe with the tubular portion extending coaxially down into the upper end of the drain pipe and the flange extending radially outwardly sealing the upper open end of the drain pipe to igress of water other than via the upper open end of the tubular portion, said tubular portion comprising said annular restriction member.

12. A drain as claimed in claim 11 wherein said annular restriction member comprises a lowermost portion of said tubular portion.

13. A drain as claimed in claim 12 wherein said annular restriction member includes a ring-like sealing member coaxially disposed between said drain pipe and said tubular portion to form a seal therebetween.

14. A drain as claimed in claim 13 wherein said annular restriction member includes a ring-like member engaging said tubular portion to form a seal therewith, wherein said ring-like member when compressed by axially directed forces expands radially outwardly to sealably engage interior surfaces of the drain pipe, and the drain includes a mechanism to axially compress said ring-like member.

15. A drain as claimed in claim 8 comprising a roof drain.

16. A drain as claimed in claim 11 comprising a roof drain.

17. A drain as claimed in claim 14 comprising a roof drain.

* * * * *